US008087570B2

(12) United States Patent
Ho Fung

(10) Patent No.: US 8,087,570 B2
(45) Date of Patent: Jan. 3, 2012

(54) CARTON WITH DISPENSER, DISPLAY FEATURES AND/OR CORNER FEATURES

(75) Inventor: Charles F. Ho Fung, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/652,249

(22) Filed: Jan. 5, 2010

(65) Prior Publication Data

US 2010/0140336 A1 Jun. 10, 2010

Related U.S. Application Data

(63) Continuation of application No. PCT/US2008/071307, filed on Jul. 28, 2008.

(60) Provisional application No. 60/962,244, filed on Jul. 27, 2007.

(51) Int. Cl.
*B65D 5/08* (2006.01)
*B65D 5/56* (2006.01)
*B65D 17/28* (2006.01)

(52) U.S. Cl. ..... 229/109; 229/116.1; 229/122.32; 229/122.33; 229/136; 229/242

(58) Field of Classification Search ..... 229/109, 229/116.1, 930, 122.32, 122.33, 240, 242, 229/132, 136; 206/427
See application file for complete search history.

(56) References Cited

U.S. PATENT DOCUMENTS

| | | | | |
|---|---|---|---|---|
| 2,152,079 | A * | 3/1939 | Mott | 206/746 |
| 2,710,134 | A * | 6/1955 | Schroeder et al. | 229/122.32 |
| 2,755,984 | A | 7/1956 | Reifers | |
| 3,098,599 | A | 7/1963 | Hagan | |
| 3,186,545 | A * | 6/1965 | Conrades | 229/240 |
| 4,058,250 | A * | 11/1977 | Akkerman | 229/117.16 |
| 4,059,220 | A * | 11/1977 | Lorenz | 229/159 |
| 4,373,929 | A * | 2/1983 | Smith | 229/930 |
| 4,566,593 | A * | 1/1986 | Muller | 206/434 |
| 4,577,799 | A | 3/1986 | Oliff | |
| 4,946,093 | A | 8/1990 | Moorman | |
| 5,386,937 | A | 2/1995 | Crawford | |
| 5,447,270 | A * | 9/1995 | McNown | 229/199 |
| 5,505,372 | A * | 4/1996 | Edson et al. | 229/121 |
| 6,227,367 | B1 | 5/2001 | Harrelson et al. | |
| 6,968,992 | B2 * | 11/2005 | Schuster | 229/242 |
| 6,997,316 | B2 | 2/2006 | Sutherland | |
| 7,416,109 | B2 | 8/2008 | Sutherland | |
| 7,699,215 | B2 | 4/2010 | Spivey, Sr. | |
| 7,703,666 | B2 | 4/2010 | Hand et al. | |
| 7,762,394 | B2 * | 7/2010 | Bradford et al. | 206/427 |
| 2002/0134698 | A1 | 9/2002 | Rhodes et al. | |
| 2004/0188508 | A1 * | 9/2004 | Holley et al. | 229/242 |
| 2006/0231604 | A1 | 10/2006 | DeBusk et al. | |

(Continued)

OTHER PUBLICATIONS

International Search Report and Written Opinion—PCT/US2008/071307.
Supplementary European Search Report—EP 08 796 682.

*Primary Examiner* — Gary Elkins
(74) *Attorney, Agent, or Firm* — Womble Carlyle Sandridge & Rice LLP

(57) ABSTRACT

A carton has a multi-ply configuration formed by overlying a primary blank with one or more reinforcing blanks. A separable section can formed in one or more side panels of the carton to allow for removal of articles from the carton.

52 Claims, 12 Drawing Sheets

U.S. PATENT DOCUMENTS

2006/0266815 A1* 11/2006 Coltri-Johnson et al. .... 229/242
2007/0080199 A1* 4/2007 Sutherland ..... 229/122.1
2007/0131749 A1* 6/2007 Coltri-Johnson et al. . 229/122.1
2007/0267466 A1* 11/2007 Brand et al. ..... 229/122.32
2011/0011924 A1 1/2011 Spivey, Sr. et al.
2011/0030321 A1 2/2011 Brand

* cited by examiner

CARTON WITH DISPENSER, DISPLAY FEATURES AND/OR CORNER FEATURES

PRIORITY

This application is a continuation of International Application No. PCT/US2008/071307, filed Jul. 28, 2008, entitled "Carton With Dispenser, Display Features and/or Corner Features," which designates the United States of America and which claims the benefit under 35 U.S.C. §119(e) of U.S. Provisional Application No. 60/962,244, filed Jul. 27, 2007.

BACKGROUND

This invention relates to cartons or sleeves used to store or carry products. The cartons or sleeves are formed from blanks and generally surround or hold at least a portion of the product or articles placed therein.

SUMMARY

The entire disclosures of International Application No. PCT/US2008/071307 and U.S. Provisional Application No. 60/962,244 are hereby incorporated by reference in their entirety as though fully set forth herein.

Cartons are typically shipped in bulk quantities. During shipping, the cartons may be vertically stacked upon each other in order to maximize the amount of product shipped in a particular vessel. The amount of product shipped may depend, however, on the load-bearing capacity of the stacked cartons. It is therefore desirable to produce cartons having high rigidity and/or strength in compression for shipping, and for other purposes such as the protection of the carton contents in general.

In order to increase the strength of a carton some conventional cartons provide blank of a different, stronger board material (such as corrugated material) or produce the blank from the a greater thickness carton material. These conventional cartons suffer from typically increased costs associated with manufacturing the carton, since the material costs of manufacture generally increase according to the cost of increasing the strength and/or thickness of the entire blank. Since, however, some sections of the blank, however, may not be load-bearing, the additional costs associated with increasing the strength of non-load-bearing sections of the blank are wasted.

According to a first aspect of the invention, a carton is formed from a multi-ply blank. The multi-ply blank includes a primary blank and one or more reinforcing blanks overlying the primary blank. The reinforcing blanks can be adhered and/or otherwise attached to selected locations on the primary blank in order to increase desirable properties such as, for example, strength and rigidity in the resultant or combination carton. The size and location of the applied reinforcing blanks can be selected, for example, to minimize board use while providing a desired level of increased strength and/or rigidity.

According to another aspect of the invention, angled or beveled corner features can be formed at one or more intersections of side and end panels of the carton. The corner features provide additional strength to the carton.

According to yet another aspect of the invention, a dispenser feature can be formed in the carton to facilitate removal of articles from the carton.

According to yet another aspect of the invention, an aperture can be provided in the carton such that articles accommodated in the carton are visible from the carton exterior. The aperture can serve as a starting point for accessing the dispenser of the carton.

In another aspect, the invention includes a multi-ply blank for forming a carton, with the multi-ply blank including at least a primary blank and a first reinforcing blank. The primary blank includes a first panel connected to a second panel along a first fold line, the second panel is connected to a third panel along a second fold line, and the third panel is connected to a fourth panel along a third fold line. A first top end flap is connected to the first panel along a first traverse fold line, which is transverse to the first fold line. A first corner feature is disposed along the first transverse fold line between the first panel and the first end flap. The first reinforcing blank is attached to the primary blank. Alternatively, a separable portion is formed at least partially in the second panel of the primary blank. The separable portion can be defined at least partially by a tear line that extends from the second panel into the third panel across the second fold line. The tear line generally is substantially continuous and separated at its perimeter by an opening feature, which can be formed in the third panel and which can be covered by a finger flap. Further, at least a second end flap can be connected to the second panel along the first transverse fold line, and a third end flap can be connected to the third panel along the transverse fold line. A second corner feature can be disposed along the first transverse fold line between the third panel and the third end flap. Further still, at least one handle feature can be disposed in either the first panel or the fourth panel, and an adhesive flap can be attached to the fourth panel along a fourth fold line. Alternatively still, a second reinforcing blank can be attached to the primary blank. In such arrangement, the first reinforcing blank can be disposed along the first transverse fold line, and the second reinforcing blank can be disposed along a second transverse fold line, with the second transverse fold line disposed on an opposite side of the first panel parallel the first transverse fold line. Further still, at least a first bottom end flap can be to the first panel along the second transverse fold line, a second bottom end flap can be connected to the second panel along the second transverse fold line, a third bottom end flap can be connected to the third panel along the second transverse fold line, and a fourth bottom end flap can be connected to the fourth panel along the second transverse fold line. Even further still, at least a second corner feature can be disposed along the second transverse fold line between the first panel and the first bottom end flap, a third corner feature can be disposed along the second transverse fold line between the third panel and the third bottom end flap, and a fourth corner feature can be disposed along the second transverse fold line between the fourth panel and the fourth bottom end flap.

In another aspect, the invention includes a carton formed of a multi-ply blank that includes a primary blank and a first reinforcing blank. The primary blank including a first panel connected to a second panel along a first fold line. The second panel is connected to a third panel along a second fold line and the third panel is connected to a fourth panel along a third fold line. A first top end flap is connected to the first panel along a first transverse fold line, which is transverse to the first fold line. A first corner feature is provided along the first transverse fold line between the first panel and the first end flap. The first reinforcing blank is attached to the primary blank. The first corner feature has a beveled shape and strengthens the carton. Optionally, the carton includes a separable portion is formed at least partially in the second panel of the primary blank. Further, the separable portion can be defined at least partially by a tear line, which can extend from the second panel into the third panel across the second fold line. The tear line can be substantially continuous and separated at its perimeter by an opening feature, the opening feature capable of being utilized as a starting point for separating the separable portion along the tear line. The opening feature can be an opening formed in the third panel. The opening feature can be covered by a finger flap. The carton can also include at least a second end flap connected to the second panel along the first transverse fold line, a third end flap connected to the third panel along the transverse fold line, and a second corner feature is disposed along the first transverse fold line and disposed between the third panel and the third end flap. The carton can also include at least one handle feature in either the first panel or the fourth panel. The carton can also include an adhesive flap attached to the fourth panel along a fourth fold line. Optionally still, the carton can include a second reinforcing blank attached to the primary blank, with the first reinforcing blank along the first transverse fold line and with the second reinforcing blank along a second transverse fold line. The second transverse fold line on an opposite side of the first panel, parallel the first transverse fold line. The carton can also include at least a first bottom end flap connected to the first panel along the second transverse fold line, a second bottom end flap connected to the second panel along the second transverse fold line, a third bottom end flap connected to the third panel along the second transverse fold line, and a fourth bottom end flap connected to the fourth panel along the second transverse fold line. The carton can also include at least a second corner feature along the second transverse fold line between the first panel and the first bottom end flap. The carton can also include a third corner feature along the second transverse fold line between the third panel and the third bottom end flap, and a fourth corner feature along the second transverse fold line between the fourth panel and the fourth bottom end flap. The carton can also include a separable portion formed at least partially in the second panel of the primary blank between the first reinforcing panel and the second reinforcing panel.

In yet another aspect, the invention includes a method of dispensing from a carton formed of a multi-ply blank formed of a primary blank and a first reinforcing blank. The primary blank including a first panel connected to a second panel along a first fold line. The second panel is connected to a third panel along a second fold line. The third panel is connected to a fourth panel along a third fold line. A first top end flap is connected to the first panel along a first transverse fold line, which is transverse to the first fold line. A first corner feature is provided along the first transverse fold line between the first panel and the first end flap. The first reinforcing blank is attached to the primary blank. The method including the steps of forming the multi-ply blank into the carton for receiving articles and separating a separable portion along a tear line, with the separable portion being located at least partially in the second panel of the primary blank. Optionally, the method can provide a second reinforcing blank attached to the primary blank and the separable portion can be defined in the primary blank between the first reinforcing blank and the second reinforcing blank.

The foregoing and other features, aspects, and advantages of the invention will become more apparent upon review of the detailed description of the embodiments set forth below when taken in conjunction with the accompanying drawing figures, which are briefly described as follows.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

Figure 1:
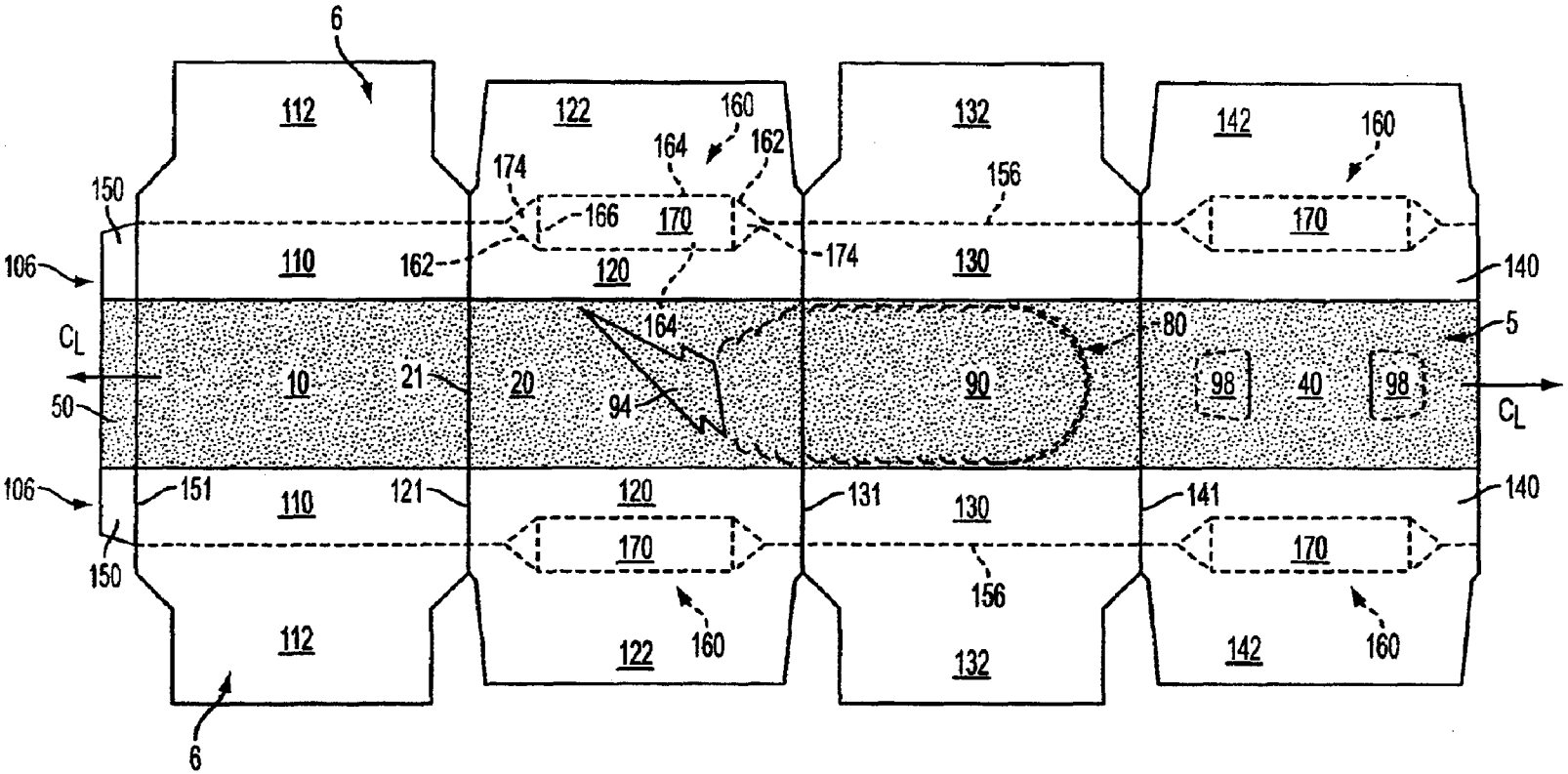
FIG. 1 is a plan view of an interior side of a multi-ply blank used to form a carton according to a first embodiment of the invention.
Figure 2:
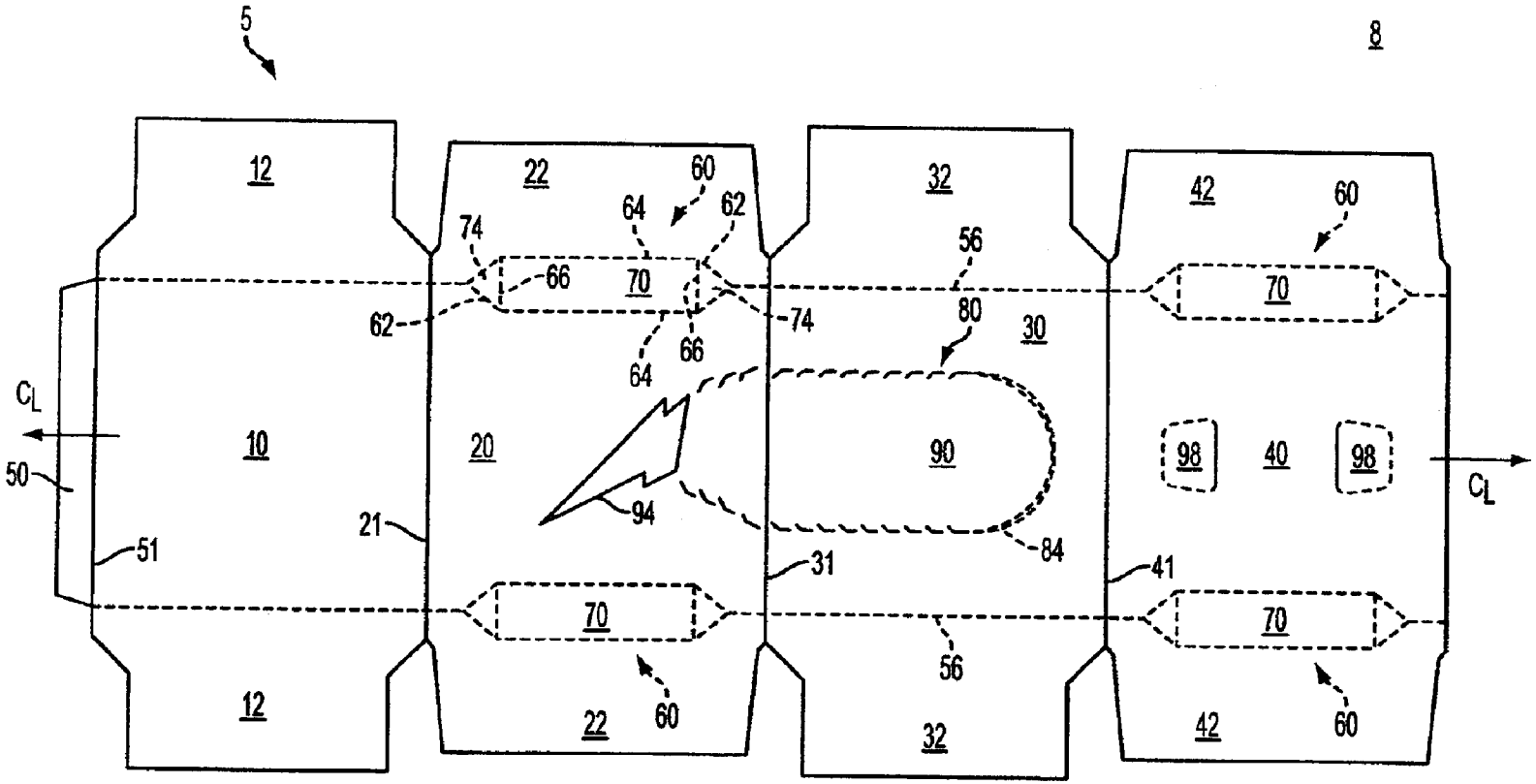
FIG. 2 is a plan view of the exterior or print side of the multi-ply blank according to the first embodiment of the invention.
Figure 3:
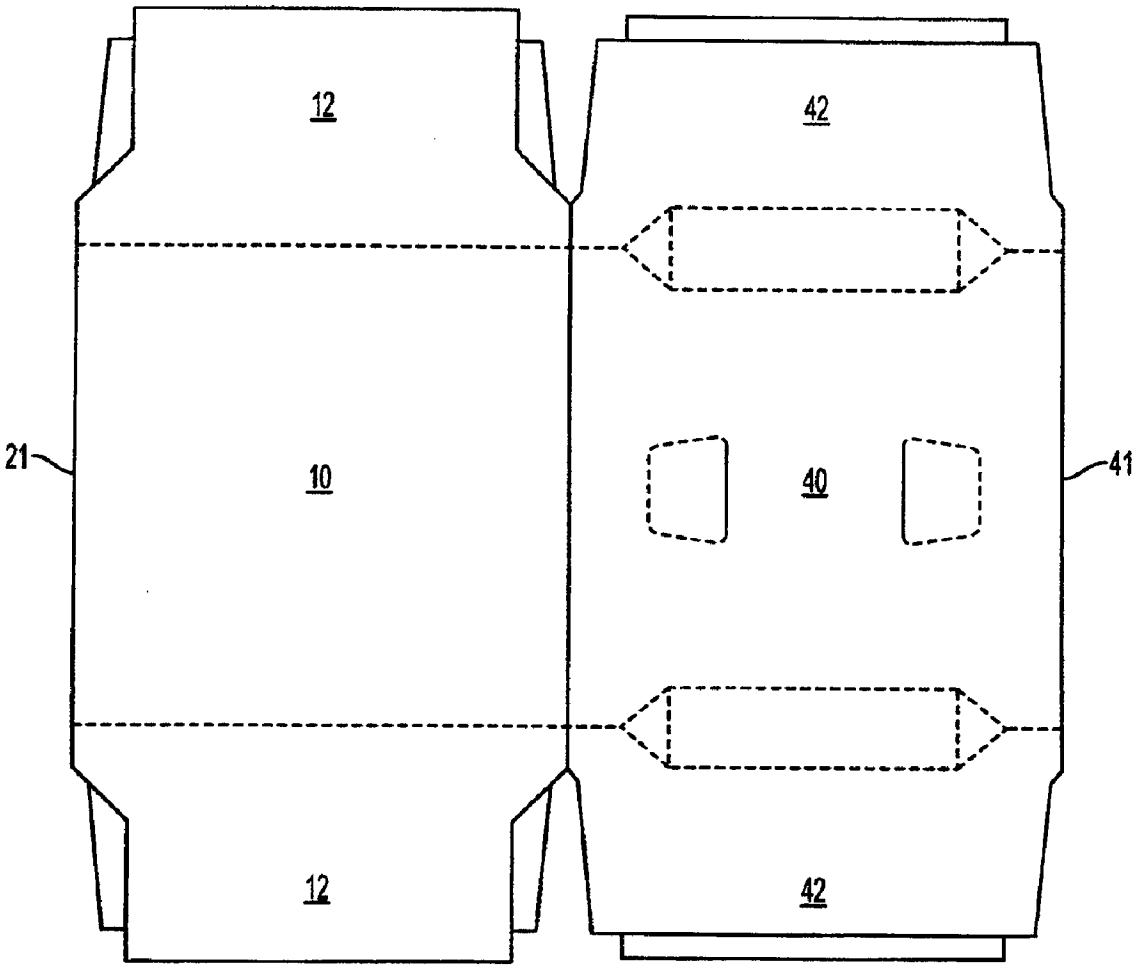

FIG. 3 illustrates a first step of erecting the blank of FIGS. 1 and 2 with panel 40 being attached to panel 50.

Figure 4:
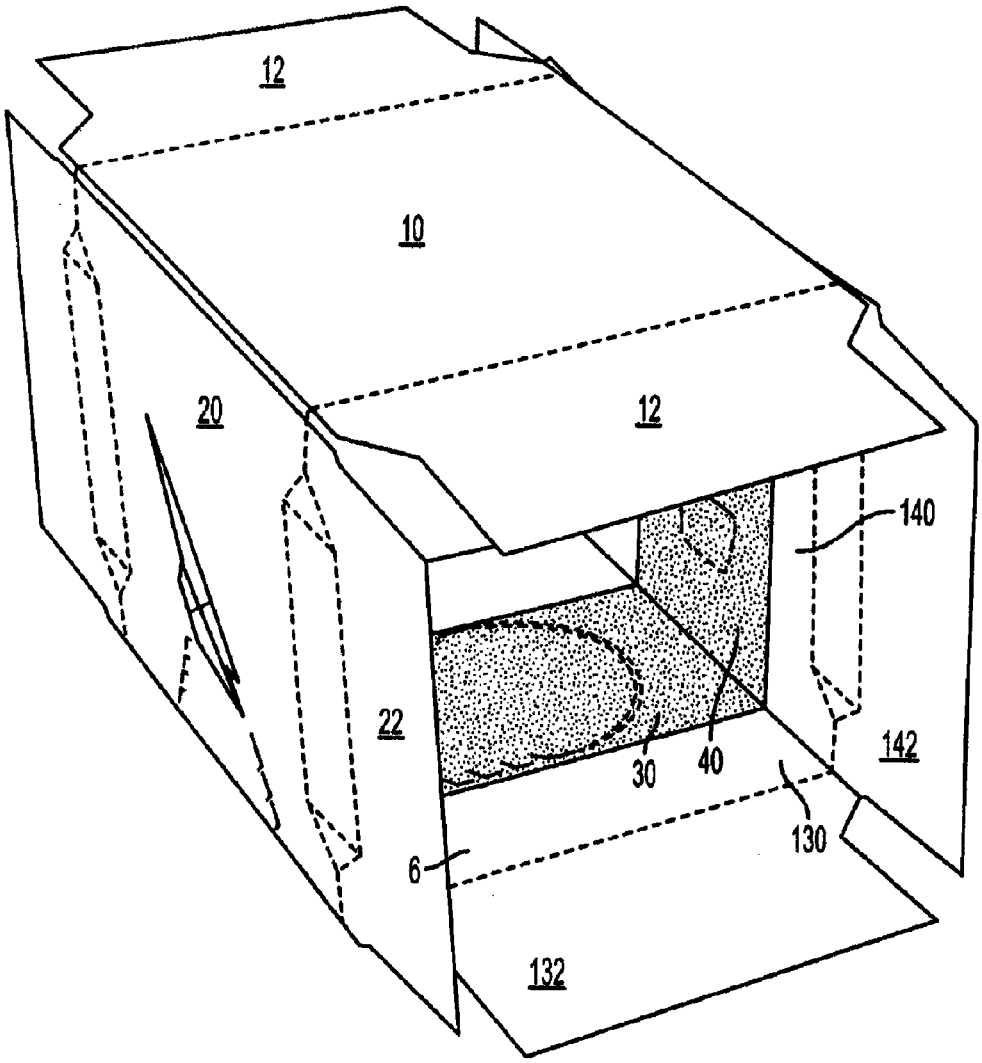

FIG. 4 illustrates a second step of erecting the blank into a sleeve.

Figure 5:
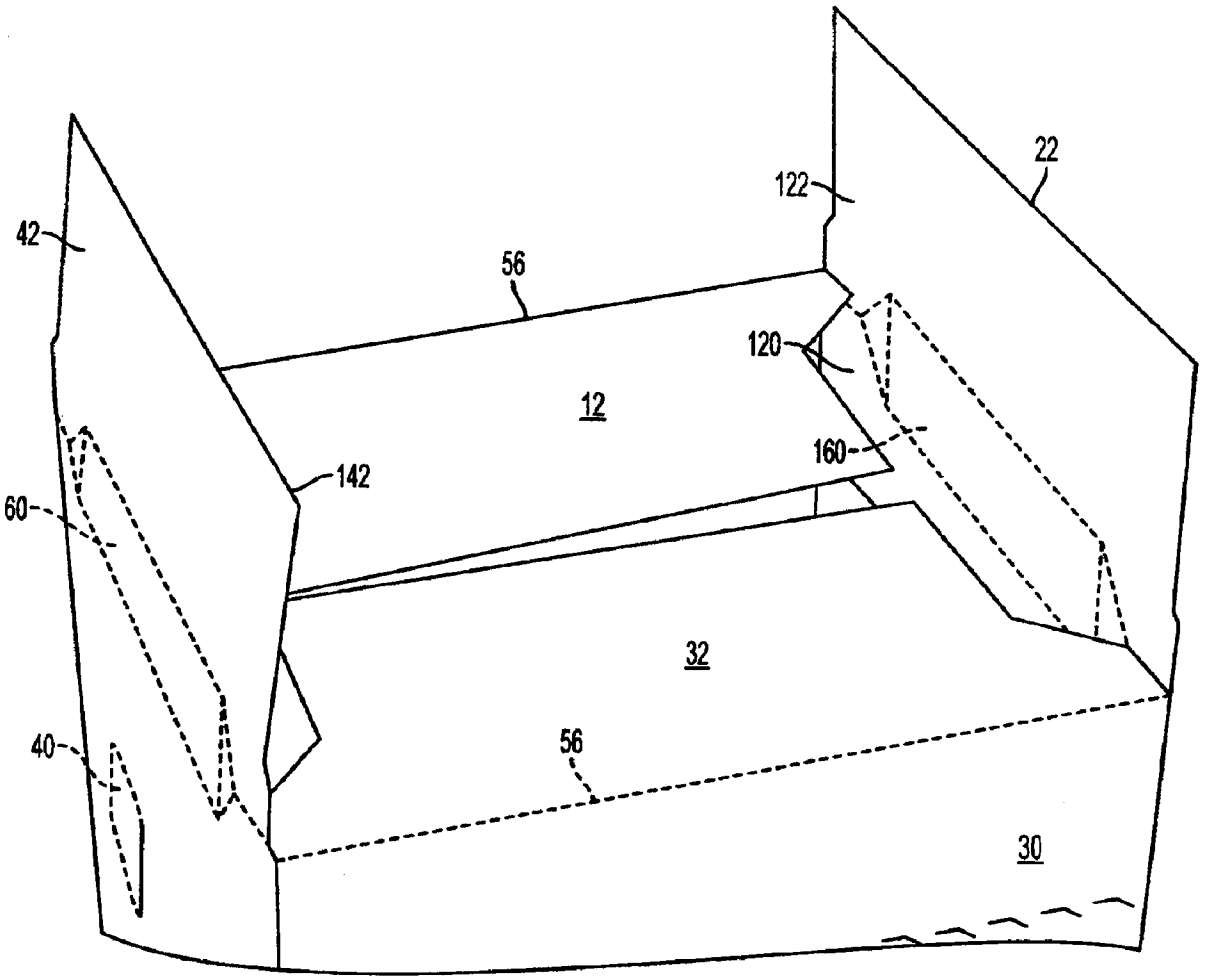
Figure 6:
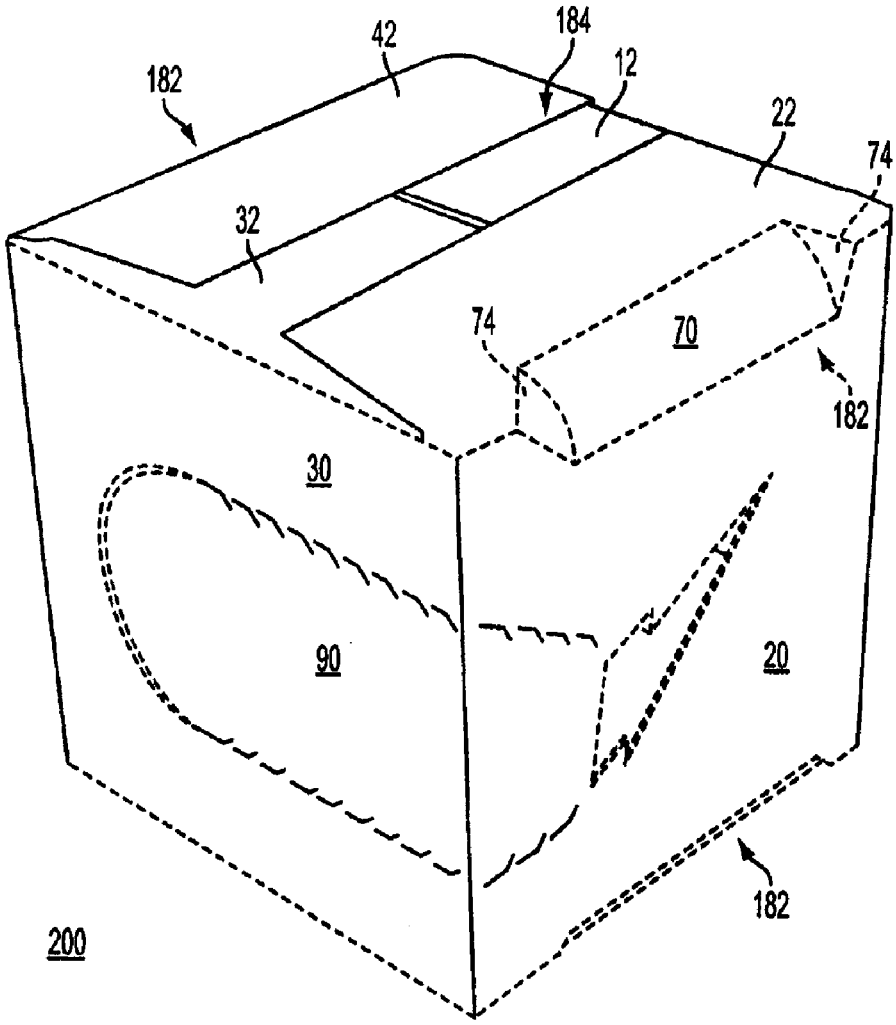
Figure 7:
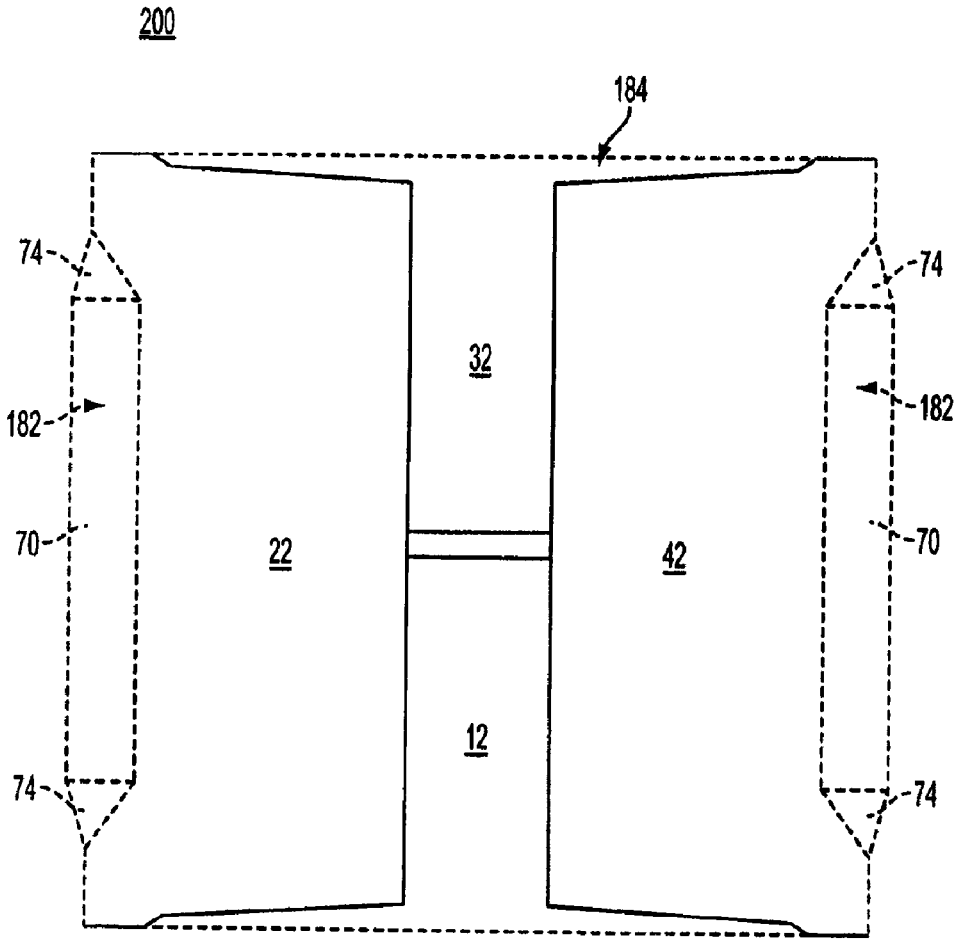
Figure 8:
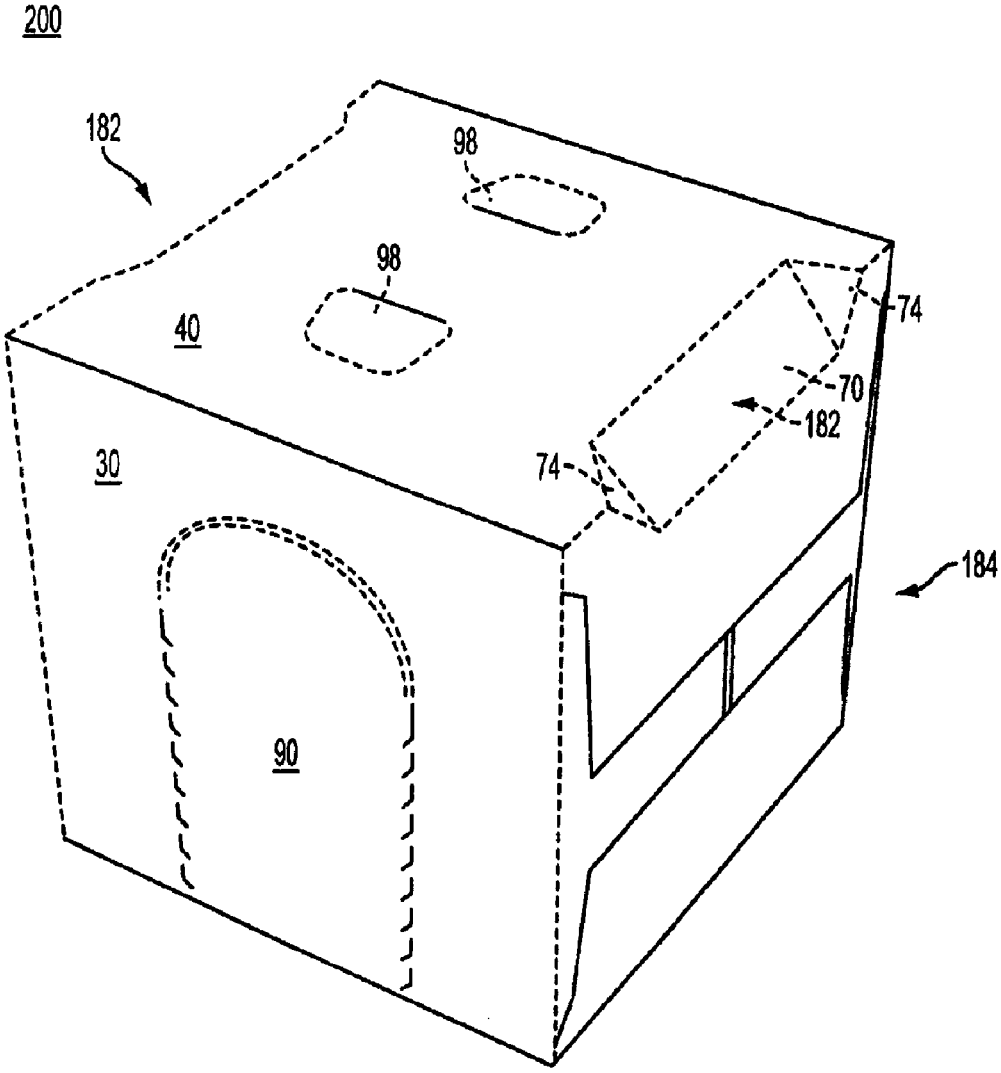
Figure 9:
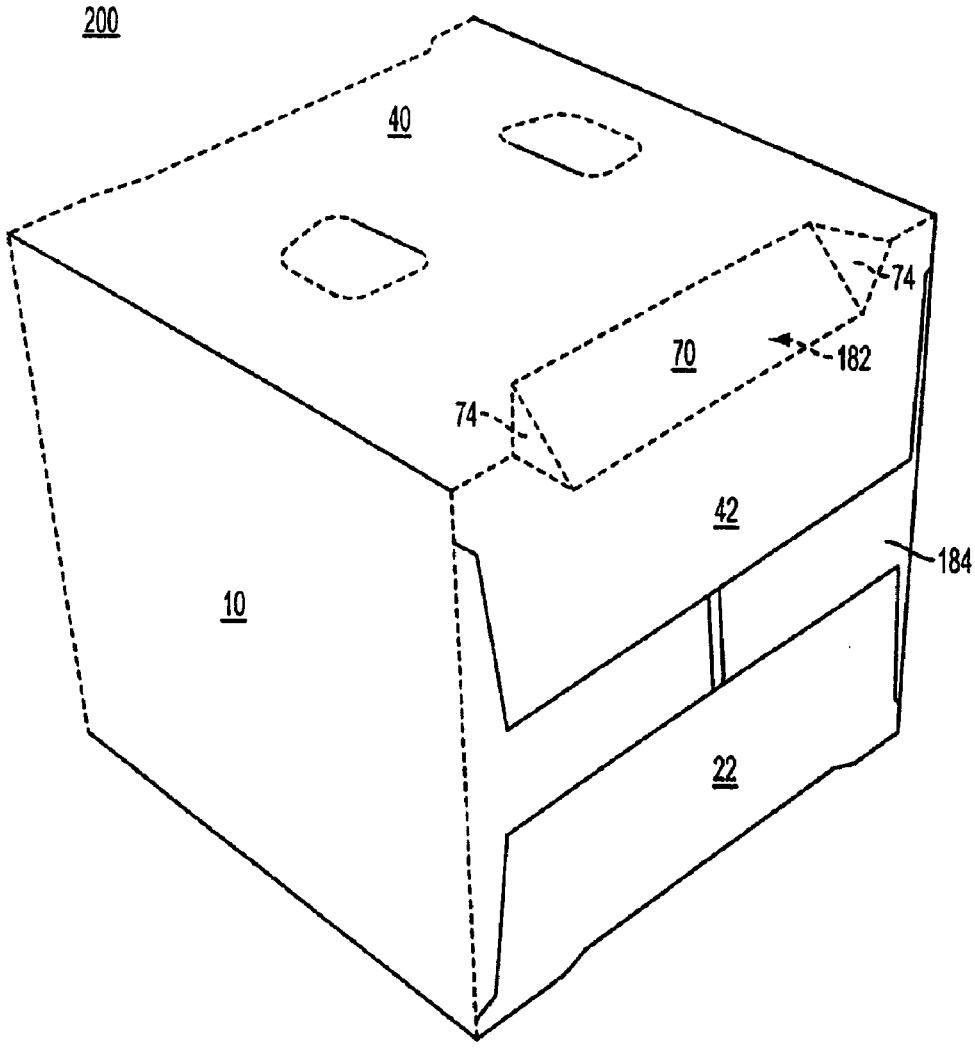

FIG. 5 illustrates a third step of closing the end flaps of the sleeve to form an enclosed carton.

FIGS. 6-9 illustrate various views of the first carton embodiment.

Figure 10:
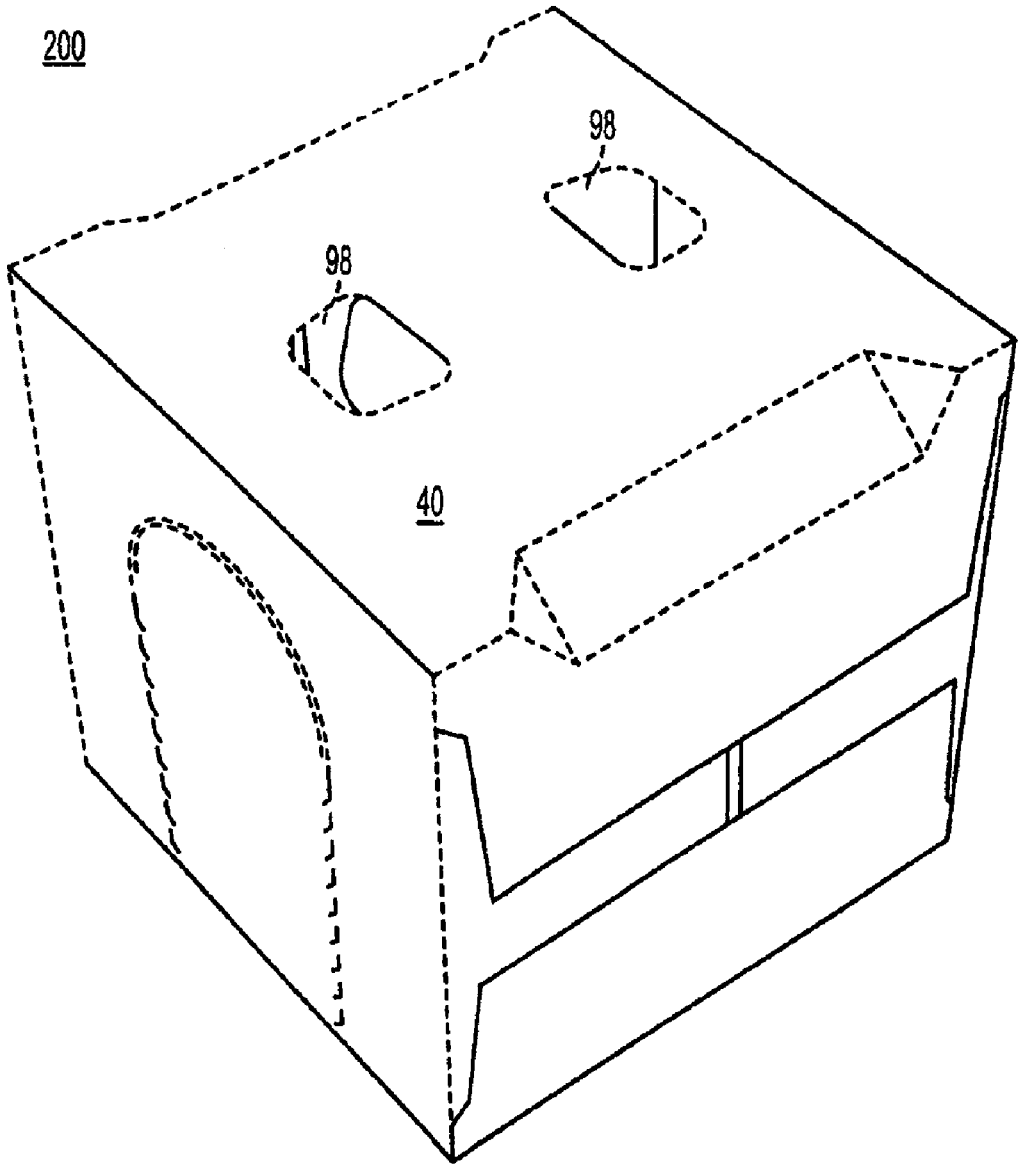

FIG. 10 illustrates the first carton embodiment with handle features engaged.

Figure 11:
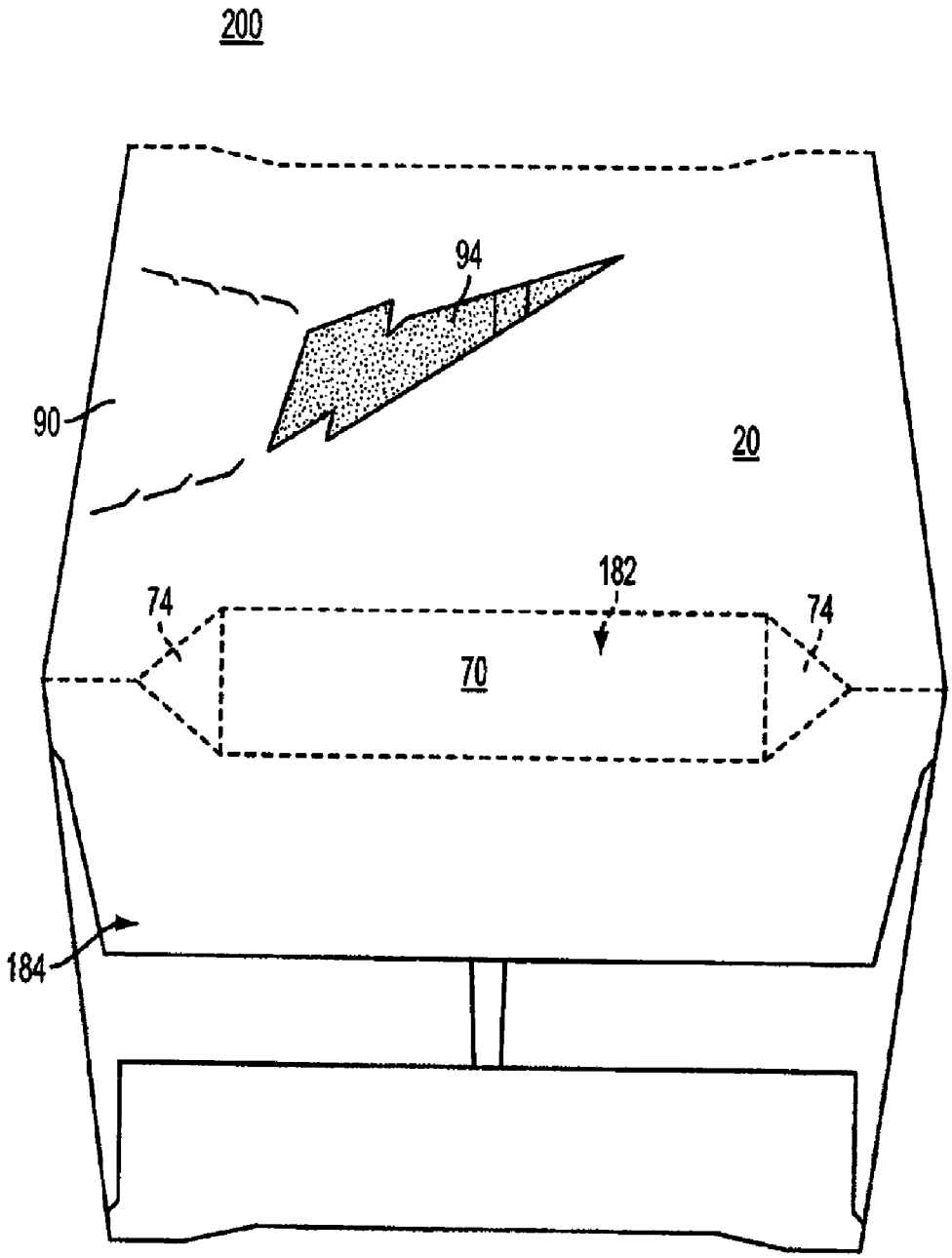

FIG. 11 illustrates a dispenser of the first carton embodiment.

Figure 12:
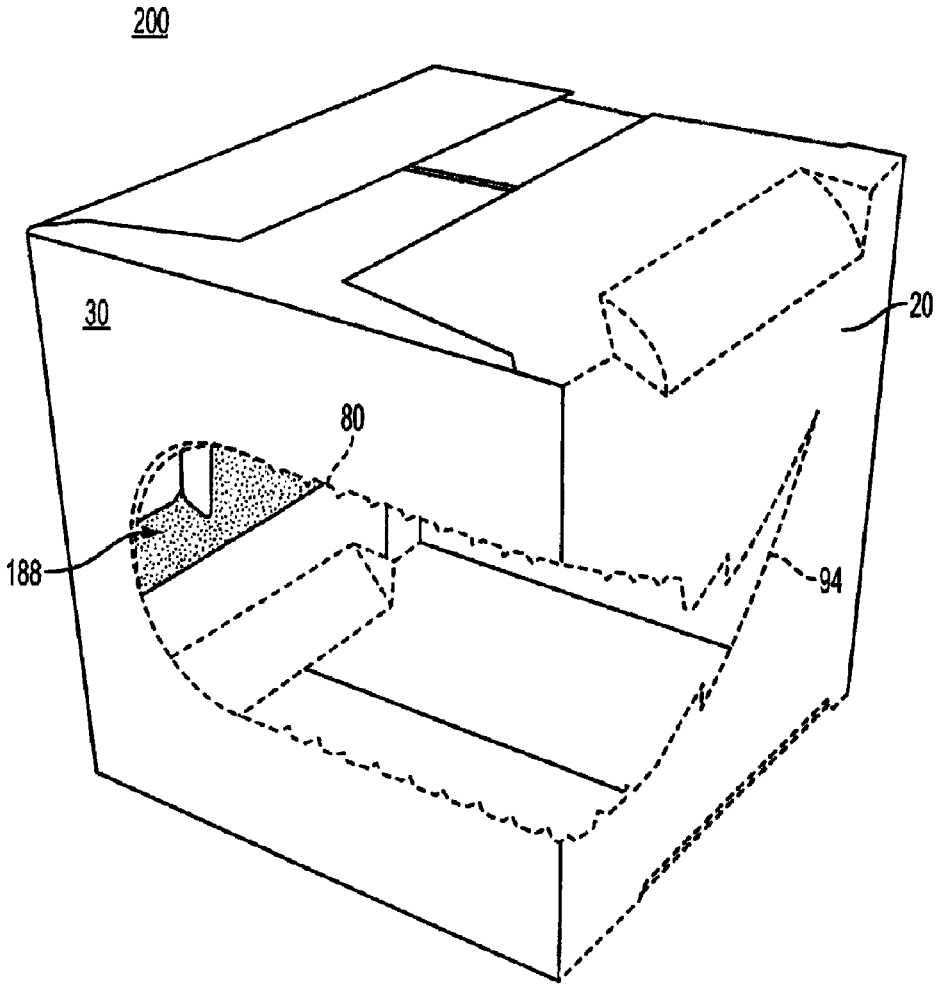

FIG. 12 illustrates the first carton embodiment after opening and removing the dispenser.

DETAILED DESCRIPTION

Briefly described, the present invention is directed to cartons having enhanced strength and rigidity. The cartons are formed from primary blanks reinforced with one or more reinforcing blanks adhered to the primary blanks. In this specification, the terms "side," and "end" are used for ease of description are not intended to limit the scope of the invention or to imply relative sizes or orientations of panels or flaps.

FIG. 1 is a plan view of the interior side of a multi-ply blank 8 comprising a primary or exterior blank 5 and first and second interior or reinforcing blanks 6 adhered to the primary blank 5. The multi-ply blank 8 is used to form a carton 200 (illustrated in FIGS. 6-9) according to a first embodiment of the invention. The interior sides of the blanks 5, 6 will generally be disposed in the interior of the erected carton 200.

As discussed in further detail below, the reinforcing blanks 6 can have plan areas or "footprints" that are complementary to and overlap with portions of the footprint of the primary blank 5. One or more sections of the perimeter edges of the reinforcing blanks 6 can also coincide with portions of the perimeter edge of the primary blank 5. The blank 8 is "multi-ply" in that the primary and reinforcing blank plies 5, 6 comprising the blank 8 include substantial overlapping portions. The terms "two-ply" and "multi-ply" are not intended to indicate that all sections of the blank 8 are formed from two or more plies. For example, the reinforcing blanks 6 may have slightly different footprints than the primary blank 5, and need not overlap the primary blank 5 at all points.

FIG. 2 is a plan view of the exterior or print side of the multi-ply blank according to the first embodiment of the invention. As shown in FIGS. 1 and 2, the multi-ply blank 8 may be wholly or partially symmetric about a longitudinal centerline $C_L$. Therefore, certain elements in the drawing figures share common reference numerals in order to reflect the whole and/or partial longitudinal symmetry.

Referring to FIGS. 1 and 2, the primary blank ply 5 of the multi-ply blank 8 comprises a first side panel 10 foldably connected to a second side panel 20 at a first transversely extending fold line 21, a third side panel 30 foldably connected to the second side panel 20 at a second transverse fold line 31, and a fourth side panel 40 foldably connected to the third side panel 30 at a third transverse fold line 41. An adhesive panel 50 may be foldably connected to the first side panel 10 at a fourth transverse fold line 51.

In the primary blank 5, the first side panel 10 is foldably connected at each end to a first side end flap 12. The second side panel 20 is foldably connected at each end to a second side end flap 22. The third side panel 30 is foldably connected at each end to a third side end flap 32. The fourth side panel 40 is foldably connected at each end to a fourth side end flap 42. The end flaps 12, 22, 32, 42 extend along a first and a second marginal area of the primary blank 5, and may be connected at first and second longitudinally extending fold lines 56. As shown in FIG. 2, the longitudinal fold lines 56 may be interrupted at corner or bevel features 60. The longitudinal fold lines 56 may be straight, or offset at one or more locations to account for, for example, blank thickness. If the corner features 60 are omitted, the fold lines 56 can be continuous across the length of the blank 8.

According to an aspect of the present invention, a corner feature 60 is located at each end of the second side panel 20 and at each end of the fourth side panel 40 of the primary blank 5. Each corner feature 60 is defined at its periphery by opposed V-shaped lines of disruption 62 that connect spaced, parallel longitudinal lines of disruption 64. Transverse lines of disruption 66 extend from ends of the spaced longitudinal lines of disruption 64. The lines of disruption 64, 66 define a rectangular corner panel 70 between the side panels 20, 40 and their associated end flaps 22, 42. A triangular panel 74 is foldably connected at each end of the corner panel 70 at the transverse lines of disruption 66. Additional corner features 60 may be formed in the blank 8, such as at the ends at the side panels 10, 30.

According to another aspect of the present invention, the primary blank 5 includes a dispenser pattern 80. In the exemplary embodiment, the dispenser pattern 80 is formed in the second and third side panels 20, 30. The dispenser pattern 80 includes a breachable line 84 of disruption extending through the second and third side panels 20, 30 and defining a removable dispenser section 90. An aperture 94 can be formed in the second side panel 20 adjacent to the dispenser section 90. Handle features 98 can be formed in one or more of the side panels 10, 20, 30, 40.

According to yet another aspect of the present invention, each reinforcing blank 6 has a perimeter edge and/or footprint that may be wholly or in part complementary to the perimeter edge and/or footprint the primary blank 5. In one embodiment of the invention, as illustrated in FIG. 1, the reinforcing blanks 6 are mirror images of one another, and are symmetric with respect to one another about the longitudinal centerline $C_L$. In this embodiment, the perimeter exterior edges of the reinforcing blanks 6 coincide with or approximately coincide with the exterior edge of the primary blank 5 at the first and second marginal areas of the blank 5.

With continuing reference to FIG. 1, each reinforcing blank 6 includes a strip 106 of sequentially arranged rectangular reinforcing side panels 110, 120, 130, 140, 150 that are foldably connected at transversely extending fold lines 121, 131, 141, 151, respectively. The reinforcing side panels 110, 120, 130, 140 are foldably connected to reinforcing end flaps 112, 122, 132, 142, respectively, at interrupted longitudinal fold lines 156. Corner features 160 are also formed in the reinforcing blanks 6. The corner features 160 include rectangular corner or bevel panels 170 and triangular panels 174 defined by lines of disruption 162, 164, 166.

The lines of disruption 21, 31, 41, 51, 56, 62, 64, 66, 84, 121, 131, 141, 151, 156, 162, 164, 166 may be, for example, score lines, cut-space lines, cut-crease lines, cuts, overlapping and/or sequential combinations thereof, or other lines of disruption that facilitate folding, bending and/or erection of the multi-ply blank 8. In the illustrated exemplary embodiment, the lines of disruption 21, 31, 41, 51, 66, 121, 131, 141, 151, 166 are creases, the lines of disruption 56, 62, 64, 156, 162, 164 are cut-creases, and the breachable line of disruption 84 is a tear line. The cutout section struck from the primary blank 5 and forming the aperture 94 may alternatively be formed from a knockout section that is removed, for example, before or during erection of the blank 8.

According to one exemplary method of assembling the multi-ply blank 8, the reinforcing blanks 6 are placed over their respective locations at the first and second marginal areas of the primary blank 5 so that the reinforcing end flaps 112, 122, 132, 142 of the reinforcing blanks 6 overlie and generally conform in shape to corresponding end flaps 12, 22, 32, 42, respectively, of the primary blank 5. The edges of the reinforcing blanks 6 may also be aligned with the edges of the primary blank 5 at the marginal areas of the blank 5. The sequentially arranged reinforcing panels 110, 120, 130, 140, 150 of the reinforcing blanks 6 are aligned with respective panels 10, 20, 30, 40, 50 of the primary blank 5 so that the transverse fold lines 121, 131, 141, 151 of the reinforcing blanks 6 can be folded along with the transverse fold lines 21, 31, 41, 51, respectively, in the primary blank 5. The reinforcing blanks 6 are then glued, laminated, adhered or otherwise joined to the primary blank 5.

FIGS. 3-5 illustrate an exemplary method of erection of the multi-ply blank 8 into the carton 200. Certain elements of the primary blank 5 and the reinforcing blanks 6 referred to in the following description may not be visible in FIGS. 3-5, and such elements can be found in FIGS. 1 and 2.

FIG. 3 illustrates a first step of erecting the blank of FIGS. 1 and 2 with panel 40 being attached to panel 50. Referring to FIG. 3, the blank 8 is folded flat at the transverse fold lines 21, 41 of the primary blank 5 and the overlapping transverse fold lines 121, 141 of the reinforcing blanks 6. The exterior side of the adhesive panel 50 is thereby brought into contact with the interior side of the fourth side panel 40. In addition, the adhesive panels 150 of the reinforcing blanks 6 are brought into contact with the interior sides of the fourth side panels 140. The adhesive panels 50, 150 can be glued, adhered or otherwise joined to the fourth side panels 40, 140, respectively.

Referring to FIG. 4, the blank 8 may then be opened to a generally tubular or sleeve form. Referring to FIG. 5, each end of the generally tubular sleeve form may be closed, for example, by folding the end flaps 12, 32 of the major blank 5 and the adhered end flaps 112, 132 inwardly across the open ends of the tubular form. The end flaps 22, 42 and the adhered end flaps 122, 142 are then folded inwardly over the end flaps 12, 32. At each end of the tubular sleeve form, the interior side of each reinforcing end flap 122, 142 can be adhered to the exterior sides of the end flaps 12, 32 of the primary blank 5. Articles such as, for example, beverage containers, soft containers such as pouches or other articles, etc., may be loaded into the tubular sleeve at any time before one or both ends of the carton are closed by the end flaps. In the exemplary embodiment, the carton 150 may accommodate between eight to twelve ten-ounce pouch containers.

FIGS. 6-9 illustrate the erected carton 200. The carton 200 may be, for example, generally parallelepipedal, with corner features 182 formed at each end of the side panels 20, 40. The corner features 182 comprise the corner features 60 in the major blank 5 adhered to the overlapping corner features 160 in the reinforcing blanks 6. The overlapping and adhered end flaps 12, 22, 32, 42, 112, 122, 132, 142, comprise end panels 184 at each end of the carton 200. The panels 70, 170 of the corner features 182 extend obliquely to the side and end panels of the carton 200.

Referring to FIG. 10, the handle features 98 are accessible in the side panel 40. The handle features 98 can be formed from breachable lines of disruption (e.g., tear lines) that allow a user to insert his fingers in the side panel 40 and carry the carton 200. Additional handle features can be included if desired. FIG. 10 illustrates the carton 200 with the handle features 98 accessed.

FIG. 11 illustrates the second side panel 20 of the carton 200, which includes the aperture 94 next to the dispenser section 90. The aperture 94 may have, for example, a decorative perimeter shape, such as a shape corresponding to a product or seller logo, etc. The aperture 94 allows the carton contents to be viewed from the carton exterior. In one embodiment, a clear film (not shown) may be placed over the aperture 94 to allow viewing of the carton contents while preventing the contents from falling out of the carton 200.

FIG. 12 illustrates the carton 200 with the dispenser section 90 opened and removed. The dispenser section 90 may be removed by tearing along the dispenser pattern 80, leaving a dispenser opening 188 in the carton 200. The dispenser opening 188 is continuous with the aperture 94 in the side panel 20. The dispenser opening 188 can extend in two side panels 20, 30, across a corner of the carton 200, so that articles within the carton can be easily accessed. The aperture 94 is arranged next to the dispenser section 90 so that tearing of the carton 200 along the dispenser pattern 80 can be initiated at the aperture 94.

For exemplary purposes only, the carton can be formed from a blank into a substantially equal sided cube shape, such as if the blank is provided with dimensions including an overall example length of panels 10, 20, 30, 40, and 50 of at least approximately 24 19/32 inches with panel 50 having a length of at least approximately 5/8-inch, panels 10, 20, and 30 having lengths of at least approximately 6-inches, and panel 40 having a length of at least approximately 5 31/32 inch. The blank 5 can have an example width of at least approximately 12½ inch with at least approximately a 6-inch width between longitudinal fold lines 156, dispenser section 90 having a width of at least approximately 2.769-inch, and blanks 6 having widths of at least approximately 4¾ inch. The blanks can be formed of any caliper, including for example a caliper of 0.018. All dimensional information presented herein is intended to be illustrative of typical embodiments of the disclosure and is not intended to be limiting. Further, the various features of the blanks 5 and 6 and the carton formed therefrom can have dimensions other than listed herein, without departing from the scope of this disclosure.

According to the above embodiment, the reinforcing blanks 6 generally provide additional strength and rigidity to the carton 200. For example, when the carton 200 is supported on any of the side panels, the reinforcing blanks 6 provide significant strength against vertical axial compression of the carton. This feature allows the multiple cartons to be stacked in relatively high numbers. The corner features 60 provide additional strength and rigidity to the carton, particularly in compression.

The primary blank 5 can be selectively reinforced at any specified locations by one or more reinforcing blanks. Cartons formed from the resulting multi-ply blanks can accordingly have enhanced strength and rigidity at selected sections of the carton. Selected reinforcement of specific areas of a primary blank can produce high strength cartons while using relatively small amounts of reinforcing blank.

One or more of the reinforcing blanks discussed above may be omitted in the above embodiments, for example, if a lesser amount of reinforcement is sufficient for a particular application.

In accordance with the exemplary embodiments, the cartons may be constructed of paperboard, for example. The blanks, and thus the cartons, can also be constructed of other materials, such as cardboard, solid unbleached sulfate (SUS) board, or any other material having properties suitable for enabling the carton to function at least generally as described above.

The blanks can also be laminated to or coated with one or more additional sheet-like materials at selected panels or panel sections. One or more panels of the blanks discussed above can be coated with varnish, clay, or other materials, either alone or in combination. The coating may then be printed over with product, advertising, and other information or images. The blanks may also be coated to protect information printed on the blanks. The blanks may be coated with, for example, a moisture barrier layer, on either or both sides of the blanks.

For purposes of the description presented herein, the term "line of disruption" or "line of weakening" can be used to generally refer to cuts, tear lines, creases, scores, and fold lines (or overlapping and/or sequential combinations of at least one cut, crease, score, tear line, or fold line). A "breachable line of disruption" is a line of disruption that is intended to be breached during ordinary use of the carton, such as when placing the carton in a dispensing configuration. An example of a breachable line of disruption is a tear line.

In accordance with the exemplary embodiments of the present invention, a fold line can be any substantially linear, although not necessarily straight, form of disruption or weakening in a blank that facilitates folding, pivoting or bending therealong.

In the present specification, a "panel" or "flap" need not be flat or otherwise planar. A "panel" or "flap" can, for example, comprise a plurality of interconnected generally flat or planar sections.

The above embodiments may be described as having one or more panels adhered together by glue. The term "glue" is intended to encompass all manner of adhesives commonly used to secure carton panels in place.

It will be understood by those skilled in the art that while the present invention has been discussed above with reference to exemplary embodiments, various additions, modifications and changes can be made thereto without departing from the spirit and scope of the invention. For example, embodiments of the invention have been described as having several features included in combination, whereas each of these features may be included in a carton in isolation and in various combinations.

What is claimed:

1. A multi-ply blank for forming a carton, the multi-ply blank comprising:

a primary blank and a first reinforcing blank; the primary blank including:

a first panel connected to a second panel along a first fold line;

the second panel connected to a third panel along a second fold line;

the third panel connected to a fourth panel along a third fold line;

a first end flap connected to the first panel along a first transverse fold line;

the first transverse fold line being transverse to the first fold line;

a first corner feature disposed along the first transverse fold line, so that the first corner feature is positioned between the first panel and the first end flap, wherein the first corner feature interrupts the first transverse fold line so that the first corner feature is positioned between first and second portions of the first transverse fold line, and the first corner feature separates the first portion of the first transverse fold line from the second portion of the first transverse fold line;

the first reinforcing blank being attached to the primary blank; and the first reinforcing blank including a reinforcing corner feature at least partially superposed with the first corner feature of the primary blank.

2. The blank of claim 1 wherein a separable portion is formed at least partially in the second panel of the primary blank.

3. The blank of claim 2 wherein the separable portion is defined at least partially by a tear line.

4. The blank of claim 3 wherein the tear line extends from the second panel across the second fold line into the third panel.

5. The blank of claim 3 wherein the tear line is substantially continuous and separated at its perimeter by an opening feature.

6. The blank of claim 5 wherein the opening feature is an opening formed in the third panel.

7. The blank of claim 1 wherein at least a second end flap is connected to the second panel along the first transverse fold line.

8. The blank of claim 7 wherein a third end flap is connected to the third panel along the first transverse fold line.

9. The blank of claim 8 wherein:

a second corner feature is disposed along the first transverse fold line, the second corner feature interrupts the first transverse fold line so that the second corner feature is positioned between third and fourth portions of the first transverse fold line, and the second corner feature separates the third portion of the first transverse fold line from the fourth portion of the first transverse fold line, and the third end flap is connected to the third panel by each of the third portion of the first transverse fold line and the fourth portion of the first transverse fold line, so that the second corner feature is positioned between the third panel and the third end flap.

10. The blank of claim 1 wherein at least one handle feature is disposed in either the first panel or the fourth panel.

11. The blank of claim 1 wherein an adhesive flap is attached to the fourth panel along a fourth fold line.

12. The blank of claim 1 wherein a second reinforcing blank is attached to the primary blank.

13. The blank of claim 12 wherein the first reinforcing blank is disposed along the first transverse fold line.

14. The blank of claim 12 wherein the second reinforcing blank is disposed along a second transverse fold line; and the second transverse fold line is opposite from and parallel to the first transverse fold line.

15. The blank of claim 13 wherein a first bottom end flap is connected to the first panel along a second transverse fold line, a second bottom end flap is connected to the second panel along the second transverse fold line, a third bottom end flap is connected to the third panel along the second transverse fold line, and a fourth bottom end flap is connected to the fourth panel along the second transverse fold line.

16. The blank of claim 15 wherein:

a second corner feature is disposed along the second transverse fold line, the second corner feature interrupts the second transverse fold line so that the second corner feature is positioned between first and second portions of the second transverse fold line, and the second corner feature separates the first portion of the second transverse fold line from the second portion of the second transverse fold line, and the first bottom end flap is connected to the first panel by each of the first portion of the second transverse fold line and the second portion of the second transverse fold line, so that the second corner feature is positioned between the first panel and the first bottom end flap.

17. The blank of claim 16 wherein:

a third corner feature is disposed along the second transverse fold line, the third corner feature interrupts the second transverse fold line so that the third corner feature is positioned between third and fourth portions of the second transverse fold line, and the third corner feature separates the third portion of the second transverse fold line from the fourth portion of the second transverse fold line, and the third bottom end flap is connected to the third panel by each of the third portion of the second transverse fold line and the fourth portion of the second transverse fold line, so that the third corner feature is positioned between the third panel and the third bottom end flap.

18. The blank of claim 12 wherein a separable portion is formed at least partially in the second panel of the primary blank between the first reinforcing blank and the second reinforcing blank.

19. The blank of claim 1 wherein:

the first corner feature of the primary blank comprises a rectangular panel and triangular panels, and the rectangular panel is positioned between, and foldably connected to, the triangular panels.

20. The blank of claim 19 wherein the rectangular panel is at least partially defined by two transverse lines of disruption, and a triangular panel of the triangular panels is at least partially defined by a generally V-shaped line of disruption extending divergently from the first transverse fold line.

21. The blank of claim 19, wherein:

the reinforcing corner feature of the first reinforcing blank comprises a reinforcing rectangular panel and reinforcing triangular panels, the reinforcing rectangular panel is positioned between, and foldably connected to, the reinforcing triangular panels, the reinforcing rectangular panel at least partially overlaps the rectangular panel of the first corner feature, and the reinforcing triangular panels respectively at least partially overlap the triangular panels of the first corner feature.

22. The blank of claim 1 wherein the first end flap is connected to the first panel by each of the first portion of the first transverse fold line and the second portion of the first transverse fold line.

23. A carton comprising:

a plurality of panels at least partially extending around an interior of the carton, the plurality of panels comprising:

a first panel connected to a second panel along a first fold line;

the second panel connected to a third panel along a second fold line;

the third panel connected to a fourth panel along a third fold line;

a first end flap connected to the first panel along a first transverse fold line;

the first transverse fold line being transverse to the first fold line;

a first corner feature disposed along the first transverse fold line, so that the first corner feature is positioned between the first panel and the first end flap, wherein the first corner feature interrupts the first transverse fold line so that the first corner feature is positioned between first and second portions of the first transverse fold line, and the first corner feature separates the first portion of the first transverse fold line from the second portion of the first transverse fold line;

a first reinforcing liner at least partially attached to the plurality of panels, the first reinforcing liner comprising at least one reinforcing corner feature at least partially overlapping the first corner feature;

wherein each of the first corner feature and the reinforcing corner feature has a beveled shape and strengthens the carton.

24. The carton of claim 23 wherein the first end flap is connected to the first panel by each of the first portion of the first transverse fold line and the second portion of the first transverse fold line.

25. The carton of claim 23 wherein a separable portion is formed at least partially in the second panel of the plurality of panels.

26. The carton of claim 25 wherein the separable portion is defined at least partially by a tear line.

27. The carton of claim 26 wherein the tear line extends from the second panel across the second fold line into the third panel.

28. The carton of claim 26 wherein the tear line is substantially continuous and separated at its perimeter by an opening feature, the opening feature capable of being utilized as a starting point for separating the separable portion along the tear line.

29. The carton of claim 28 wherein the opening feature is an opening formed in the third panel.

30. The carton of claim 23 wherein a second end flap is connected to the second panel along the first transverse fold line.

31. The carton of claim 30 wherein a third end flap is connected to the third panel along the first transverse fold line.

32. The carton of claim 31 wherein:

a second corner feature is disposed along the first transverse fold line, the second corner feature interrupts the first transverse fold line so that the second corner feature is positioned between third and fourth portions of the first transverse fold line, and the second corner feature separates the third portion of the first transverse fold line from the fourth portion of the first transverse fold line, and the third end flap is connected to the third panel by each of the third portion of the first transverse fold line and the fourth portion of the first transverse fold line, so that the second corner feature is disposed between the third panel and the third end flap.

33. The carton of claim 23 wherein a second reinforcing liner is attached to the plurality of panels.

34. The carton of claim 33 wherein the first reinforcing liner is disposed along the first transverse fold line.

35. The carton of claim 33 wherein the second reinforcing liner is disposed along a second transverse fold line, and the second transverse fold line is opposite from and parallel to the first transverse fold line.

36. The carton of claim 34 wherein a first bottom end flap is connected to the first panel along a second transverse fold line, a second bottom end flap is connected to the second panel along the second transverse fold line, a third bottom end flap is connected to the third panel along the second transverse fold line, and a fourth bottom end flap is connected to the fourth panel along the second transverse fold line.

37. The carton of claim 36 wherein:

a second corner feature is disposed along the second transverse fold line, the second corner feature interrupts the second transverse fold line so that the second corner feature is positioned between first and second portions of the second transverse fold line, and the second corner feature separates the first portion of the second transverse fold line from the second portion of the second transverse fold line, and the first bottom end flap is connected to the first panel by each of the first portion of the second transverse fold line and the second portion of the second transverse fold line, so that the second corner feature is positioned between the first panel and the first bottom end flap.

38. The carton of claim 37 wherein:

a third corner feature is disposed along the second transverse fold line, the third corner feature interrupts the second transverse fold line so that the third corner feature is positioned between third and fourth portions of the second transverse fold line, and the third corner feature separates the third portion of the second transverse fold line from the fourth portion of the second transverse fold line, and the third bottom end flap is connected to the third panel by each of the third portion of the second transverse fold line and the fourth portion of the second transverse fold line, so that the third corner feature is positioned between the third panel and the third bottom end flap.

39. The carton of claim 33 wherein a separable portion is formed at least partially in the second panel of the plurality of panels between the first reinforcing liner and the second reinforcing liner.

40. The carton of claim 23 wherein:

the first corner feature comprises a rectangular panel and triangular panels, and rectangular panel is positioned between, and foldably connected to, the triangular panels.

41. The carton of claim 40 wherein the rectangular panel is at least partially defined by two transverse lines of disruption, and a triangular panel of the triangular panels is at least partially defined by a generally V-shaped line of disruption extending divergently from the first transverse fold line.

42. The carton of claim 40, wherein:

the reinforcing corner feature of the first reinforcing liner comprises a reinforcing rectangular panel and reinforcing triangular panels, the reinforcing rectangular panel is positioned between, and foldably connected to, the reinforcing triangular panels, the reinforcing rectangular panel at least partially overlaps the rectangular panel of the first corner feature, and the reinforcing triangular panels respectively at least partially overlap the triangular panels of the first corner feature.

43. The carton of claim 37, wherein the reinforcing corner feature of the first reinforcing liner is a first reinforcing corner feature, and the second reinforcing liner comprises a second reinforcing corner feature at least partially overlapping the second corner feature.

44. A carton comprising:

a plurality of panels at least partially extending around an interior of the carton, the plurality of panels comprising:

a first panel connected to a second panel along a first fold line, a third panel connected to the second panel along a second fold line, and a fourth panel connected to the third panel along a third fold line, a first end flap connected to the first panel along a first transverse fold line, the first transverse fold line being transverse to the first fold line; and a first corner feature positioned along the first transverse fold line for strengthening the carton, wherein the first corner feature interrupts the first transverse fold line so that the first corner feature is positioned between first and second portions of the first transverse fold line, and the first corner feature separates the first portion of the first transverse fold line from the second portion of the first transverse fold line, the first end flap is connected to the first panel by each of the first portion of the first transverse fold line and the second portion of the first transverse fold line, so that the first corner feature is positioned between the first panel and the first end flap, and the first corner feature extends obliquely to each of the first panel and the first end flap.

45. The carton of claim 44, comprising:

a second end flap connected to the second panel along the first transverse fold line;

a third end flap connected to the third panel along the first transverse fold line;

a second corner feature positioned along the first transverse fold line, wherein the second corner feature interrupts the first transverse fold line so that the second corner feature is positioned between third and fourth portions of the first transverse fold line, and the second corner feature separates the third portion of the first transverse fold line from the fourth portion of the first transverse fold line, and wherein the third end flap is connected to the third panel by each of the third portion of the first transverse fold line and the fourth portion of the first transverse fold line, so that the second corner feature is positioned between the third panel and the third end flap;

a first bottom end flap connected to the first panel along a second transverse fold line;

a second bottom end flap connected to the second panel along the second transverse fold line;

a third bottom end flap connected to the third panel along the second transverse fold line;

a third corner feature positioned along the second transverse fold line, wherein the third corner feature interrupts the second transverse fold line so that the third corner feature is positioned between first and second portions of the second transverse fold line, and the third corner feature separates the first portion of the second transverse fold line from the second portion of the second transverse fold line, and wherein the first bottom end flap is connected to the first panel by each of the first portion of the second transverse fold line and the second portion of the second transverse fold line, so that the third corner feature is positioned between the first panel and the first bottom end flap; and a fourth corner feature positioned along the second transverse fold line, wherein the fourth corner feature interrupts the second transverse fold line so that the fourth corner feature is positioned between third and fourth portions of the second transverse fold line, and the fourth corner feature separates the third portion of the second transverse fold line from the fourth portion of the second transverse fold line, and wherein the third bottom end flap is connected to the third panel by each of the third portion of the second transverse fold line and the fourth portion of the second transverse fold line, so that the fourth corner feature is positioned between the third panel and the third bottom end flap.

46. The carton of claim 45, further comprising a first reinforcing liner at least partially attached to the plurality of panels, wherein:

the first reinforcing liner comprising at least one reinforcing corner feature at least partially superposed with at least one of the first, second, third and forth corner features; and each of the first, second, third and forth corner features comprises a rectangular panel positioned between, and foldably connected to, triangular panels.

47. A blank for forming a carton, comprising:

a first panel connected to a second panel along a first fold line;

a third panel connected to the second panel along a second fold line;

a fourth panel connected to the third panel along a third fold line;

a first end flap connected to the first panel along a first transverse fold line, the first transverse fold line being transverse to the first fold line; and a first corner feature positioned along the first transverse fold line, wherein the first corner feature interrupts the first transverse fold line so that the first corner feature is positioned between first and second portions of the first transverse fold line, and the first corner feature separates the first portion of the first transverse fold line from the second portion of the first transverse fold line, the first end flap is connected to the first panel by each of the first portion of the first transverse fold line, the second portion of the first transverse fold line, and the corner feature, so that the first corner feature is positioned between the first panel and the first end flap, and first corner feature comprises a panel.

48. The blank of claim 47, wherein:

the panel of the first corner feature is a rectangular panel, the first corner feature further comprises triangular panels, and the rectangular panel is positioned between, and foldably connected to, the triangular panels.

49. The blank of claim 47, comprising:

a second end flap connected to the second panel along the first transverse fold line;

a third end flap connected to the third panel along the first transverse fold line;

a second corner feature positioned along the first transverse fold line, wherein the second corner feature interrupts the first transverse fold line so that the second corner feature is positioned between third and fourth portions of the first transverse fold line, and the second corner feature separates the third portion of the first transverse fold line from the fourth portion of the first transverse fold line, and wherein the third end flap is connected to the third panel by each of the third portion of the first transverse fold line and the fourth portion of the first transverse fold line, so that the second corner feature is positioned between the third panel and the third end flap;

a first bottom end flap connected to the first panel along a second transverse fold line;

a second bottom end flap connected to the second panel along the second transverse fold line;

a third bottom end flap connected to the third panel along the second transverse fold line;

a third corner feature positioned along the second transverse fold line, wherein the third corner feature interrupts the second transverse fold line so that the third corner feature is positioned between first and second portions of the second transverse fold line, and the third corner feature separates the first portion of the second transverse fold line from the second portion of the second transverse fold line, and wherein the first bottom end flap is connected to the first panel by each of the first portion of the second transverse fold line and the second portion of the second transverse fold line, so that the third corner feature is positioned between the first panel and the first bottom end flap; and a fourth corner feature positioned along the second transverse fold line, wherein the fourth corner feature interrupts the second transverse fold line so that the fourth corner feature is positioned between third and fourth portions of the second transverse fold line, and the fourth corner feature separates the third portion of the second transverse fold line from the fourth portion of the second transverse fold line, and wherein the third bottom end flap is connected to the third panel by each of the third portion of the second transverse fold line and the fourth portion of the second transverse fold line, so that the fourth corner feature is positioned between the third panel and the third bottom end flap.

50. The blank of claim 49, wherein:

the blank is a multiply-blank; and each of the second, third and forth corner features comprises a rectangular panel positioned between, and foldably connected to, triangular panels.

51. A blank for forming a carton, comprising:

a first panel foldably connected to a second panel;

a third panel foldably connected to the second panel;

a fourth panel foldably connected to the third panel;

a corner feature foldably connected to the second panel, wherein the corner feature comprises a rectangular panel connected to the second panel by a first fold line, a first triangular panel connected to the second panel by a second fold line, a second triangular panel connected to the second panel by a third fold line, wherein the rectangular panel is positioned between, and foldably connected to, the first and second triangular panels; and an end flap foldably connected to the corner feature, wherein the rectangular panel is connected to the end flap by a fourth fold line, the first triangular panel is connected to the end flap by a fifth fold line, the second triangular panel is connected to the end flap by a sixth fold line.

52. A carton comprising the blank of claim 51 erected so that each of the rectangular panel, the first triangular panel and the second triangular panel extends obliquely to each of the second panel and the end flap.

* * * * *